US006617578B1

(12) United States Patent
Tong

(10) Patent No.: US 6,617,578 B1
(45) Date of Patent: Sep. 9, 2003

(54) SELF-ALIGNED ION GUIDE CONSTRUCTION

(75) Inventor: Roger C. Tong, Berkeley, CA (US)

(73) Assignee: Varian, Inc., Palo Alto, CA (US)

( * ) Notice: Subject to any disclaimer, the term of this patent is extended or adjusted under 35 U.S.C. 154(b) by 0 days.

(21) Appl. No.: 10/192,140

(22) Filed: Jul. 10, 2002

Related U.S. Application Data

(60) Provisional application No. 60/364,507, filed on Mar. 12, 2002.

(51) Int. Cl.[7] ..... H01J 49/00
(52) U.S. Cl. ..... 250/292; 250/396 R
(58) Field of Search ..... 250/292, 288, 250/282; 376/261, 446

(56) References Cited

U.S. PATENT DOCUMENTS 4,990,777 A 2/1991 Hurst et al.
5,729,014 A 3/1998 Mordehai et al.
5,852,294 A 12/1998 Gulcicek et al.
6,329,654 B1 12/2001 Gulcicek et al.
6,417,511 B1 * 7/2002 Russ et al. ..... 250/292
6,441,370 B1 * 8/2002 Khosla et al. ..... 250/292

* cited by examiner

*Primary Examiner*—John R. Lee
*Assistant Examiner*—Johnnie L. Smith, II
(74) *Attorney, Agent, or Firm*—Bella Fishman; Edward H Berkowitz

(57) ABSTRACT

A self-aligned ion guide assembly comprises a plurality of 2N rods radially contained by at least one insulating collar having two grooves axially displaced on the outer periphery of the collar. A wire in each groove electrically contacts and mechanically bonds to alternate rods through respective radially directed holes. Alternatively, the collar is cast about the assembly of rods and wires.

11 Claims, 3 Drawing Sheets

SELF-ALIGNED ION GUIDE CONSTRUCTION

CROSS REFERENCE TO RELATED APPLICATION

This application claims the benefit of U.S. Provisional Application No. 60/364,507 filed Mar. 12, 2002.

FIELD OF THE INVENTION

The invention relates in general to an assemblage of rods for generation of multipole fields to be employed for ion guide and mass analysis purposes, and more particularly to economical and precise construction arrangements thereof.

BACKGROUND OF THE INVENTION

The transport of ions over some spatial interval is a functional description of an ion guide. Such an ion guide is an electro-optical device for confining the ion trajectories to a generally axial locus and that confinement is achieved through the influence of an appropriate electric multipole field distribution that returns a non-axially directed ion trajectory back toward the axis. The most common structural form for such a guide consists of a number, 2N, of metal rods arranged equidistant from a central axis. Opposite and/or 180° phase shifted AC potentials are applied in common to alternate rods. The efficacy of the ion guide depends upon precise geometry of the rod assembly as well as the congruence of virtual source and exit apertures of the guide with the real apertures of devices between which the ion guide operates. In one system (a mass spectrometer), an ion source is disposed spaced apart from a mass analyzer with the ion guide therebetween. Separation of the ionization and mass analysis procedures and devices permits optimization of these procedures and hardware subject to the efficiency of the ion guide.

The prior art has approached ion guide construction through support of the array of rods with at least a pair of axially spaced support assemblies having holes for retaining the relative positions of the rods and also for providing the desired common electrical contact of alternate rods. These prior art support assemblies typically include a ceramic insulating ring having holes through which the rods pass, to define the relative disposition of the rods. Metal rings are secured to the opposite faces of the ceramic insulator and each metal ring forms a common electrical contact with one corresponding sub-set of alternate rods while maintaining electrical isolation from the other sub-set of rods. Such arrangements are described in U.S. Pat. No. 6,329,654 B 1 and in U.S. Pat. No. 5,852,294.

SUMMARY OF THE INVENTION

It is desired to achieve a precise geometry for an ion guide with a simplified assembly. This is obtained with a support collar construction employing an insulating ring having axial extent sufficient to accommodate two axially spaced peripheral grooves on the outer azimuthal surface. An inner azimuthal surface has rod conformal arcuate surface portions formed therein to locate each rod. Each groove is characterized by a set of radially directed holes azimuthally spaced $2\pi/N$ radians for an assembly of 2N rods. The angular positions for the hole set for one groove is staggered $\pi/N$ with respect to the other groove. Common electrical contact for one sub-set of N rods is realized by a conductor disposed within the groove, which contacts a rod through the respective radially directed hole.

The arcuate surface receives and constrains the outward radial locus of a rod. Electrical contact is established with a strong conducting wire captured in the groove and stressed such that when bonded through the holes to respective rods, there is an outward force on the rods balancing the inward constraining force of the arcuate surface portion against the rod, e.g., preloading the rod against the collar. As a result the ion guide assembly is a robust self aligned structure and is characterized by an aperture limited only by the rods themselves.

DETAILED DESCRIPTION OF THE INVENTION

Figure 1:
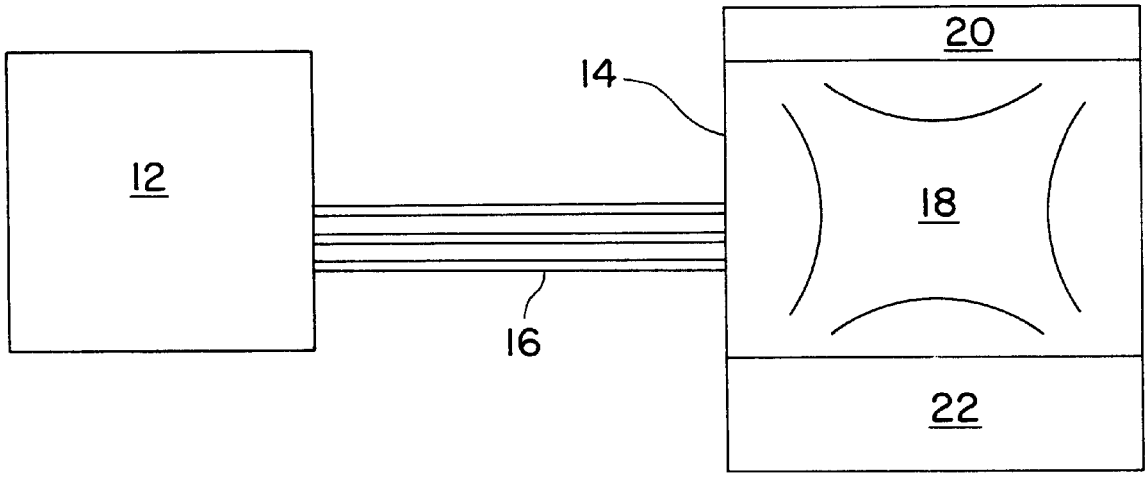
FIG. 1 shows one context for the invention.

The context of the invention is schematically shown in FIG. 1 for one representative example. For this example, an ionization chamber 12 operates on a sample to produce an ionized portion of the sample that is extracted from the ionization chamber 12 for transport through ion guide 16 to analyzer 14. Schematically shown herein is an ion trap mass analyzer comprising the ion trap 18, detector/display, recorder 20 and trap support electronics 22. The separation of the ionization process from the analysis is often advantageous for a variety of reasons outside the scope of this work.

Figure 2A:
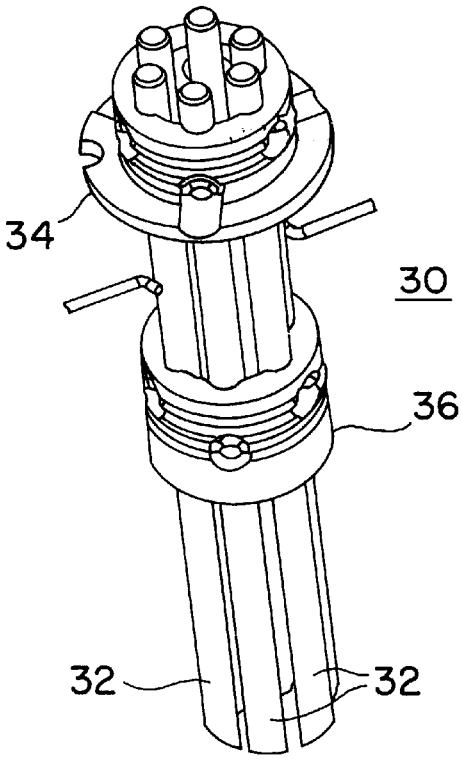
FIG. 2*a* is a perspective view of an ion guide assembly according to the invention.
Figure 2B:
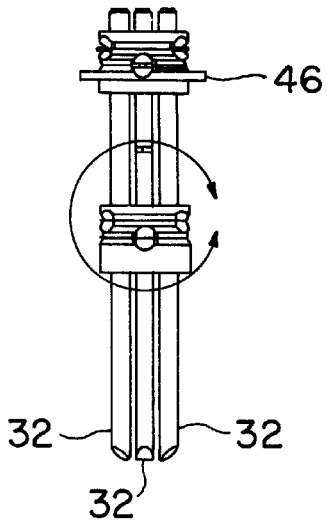
FIG. 2*b* is an elevation of the ion guide of FIG. 2*a*.
Figure 2C:
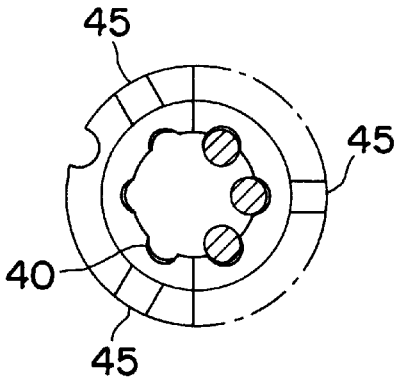
FIG. 2*c* is a section through one support collar of the invention.
Figure 3:
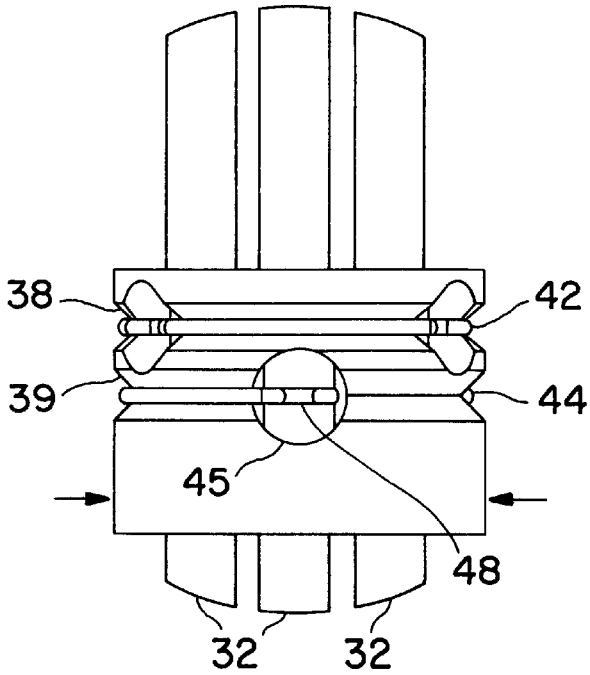
FIG. 3 shows a detail of a support collar of the invention.

The ion guide 16 shown in FIGS. 2*a* and 2*b* incorporates features of the present invention, as specialized for the example, a hexapole ion guide. An assembly 30 of 6 cylindrical rods 32 are disposed axially equidistant on a circular locus orthogonal to the rod axes. The assembly 30 further includes one or more (preferably, two) insulating collars 34 and 36 of generally cylindrical geometry FIG. 3 is a detailed illustration of the salient features of one such collar. Two grooves, 38 and 39, are inscribed on the outer azimuthal periphery of collars 34 and 36 and mutually axially displaced. The inner azimuthal periphery is characterized by rod-conformal arcuate (scalloped) portions 40 disposed at equal angular increments (here 60°). Each scalloped portion 40 defines the radial location of the rod in contact therewith and determines the axis of that individual rod, which is most usually parallel to the axes the other rods. Each groove 38 and 39 has radially directed holes formed to coincide with alternate scalloped portions 40. Conductors, preferably wires 42 and 44, are disposed within respective grooves 38 and 39 and are suitably bonded through the radially directed holes to the corresponding rods to form electrical contact as well as a durable mechanical bond therewith. As an example, FIG. 3 shows a wire 44 bonded by spot weld 48 through hole 45 to one underlying rod 32. The wires 42 and 44 are captured in the grooves 38 and 39 under sufficient stress that, when bonded through corresponding holes to respective rods, such rods are pre-loaded in respect to the collars at the scalloped portions.

Assembly of the ion guide 16 is practiced by arranging the rods about a mandrel centrally disposed within the set of rods to urge the rods outwardly against the scalloped portions 40. A wire 42, for example, is inwardly urged against the bottom of the groove and through each radially directed hole and preferably spot welded to the respective rod 11. The mandrel is then withdrawn. For a hexapole ion guide 16 comprising 6 rods (denominated A, B, C, D, E and F) each urged against scalloped portions A', B', C', D', E' and F', respectively, a wire in groove 38 for example, communicates with rods A, C and E while a wire in groove 39 would contact rods B, D and F through the corresponding radially directed holes. Electrical contact from each sub-set of rods may be effected from the wire or by a radially outward directed lead from a selected rod of each subset of rods.

In one ion guide assembly of this invention, the insulating collars are formed from a plastic such as poly-ether-ether-ketone (PEEK) to produce a robust but flexible structure. Another choice is polyphnylene sulfide (PPS), preferably glass filled for temperature stability. Ceramic, or other brittle insulator would also suffice for this purpose. Rods may be constructed of any suitable conductor, although it is generally desired that these be relatively chemically inert to an ion flux of varying character. Stainless steel wire has been used for the wire conductor 42 and spot welding to rods 32 has proved a simple and effective bond. The inventive arrangement is inherently self-aligning and easily assembled. The resulting ion guide exhibits no limiting inner diameter due to the support collars as would be the case where rods are led through holes in such supporting member. It is useful for one collar to further include a radial extension forming a flange 46 to mate with a terminal device as represented by ionization chamber 12 or analyzer 18.

A hexapole ion guide in accord with the above description has been constructed having gross dimensions of 6 cm. in length with outer collar diameter (excluding flange) of 0.50 inch. The rods were 2.4 mm. stainless steel disposed at equal 60° increments on a circle of 0.290 inch diameter. The connecting wires 42 were 0.020 in. stainless steel. The construction as described herein has been used in a mass spectrometer system as indicated in FIG. 1 and is particularly robust and tolerant of disassembly and re-assembly for cleaning, maintenance and the like.

Figure 4:
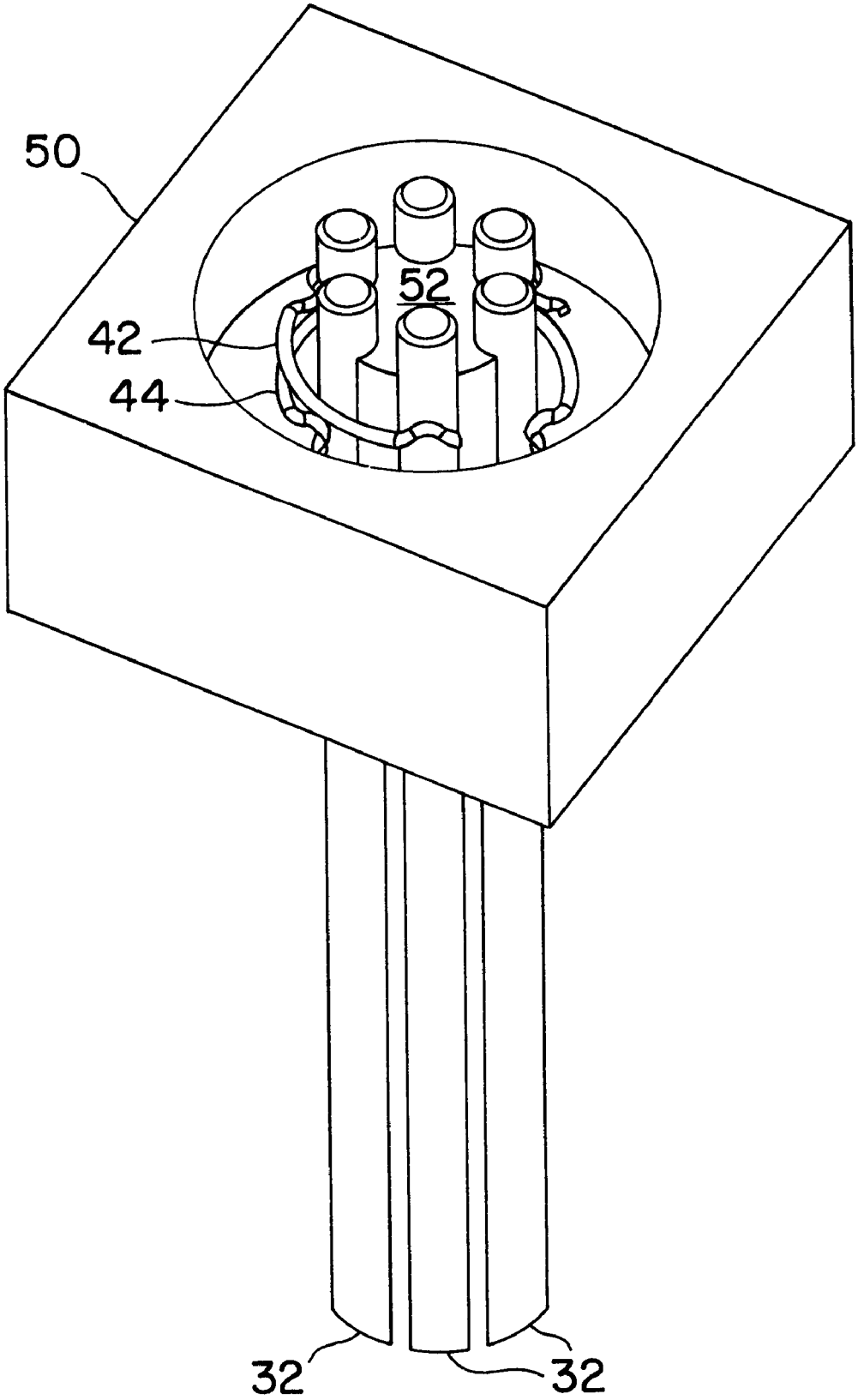
FIG. 4 is a perspective representation of an alternative form of constructing an ion guide similar to FIG. 2*a*.

In another embodiment illustrated in FIG. 4, the ion guide structure described above is constructed through a casting process by placing the rods 32 in a fixture 52 that establishes the desired spatial relationship of such rods. Conductor wires 42 are then bonded to the appropriate rods as described, via solder or tack welding. A mold 50 forms a slip fit about the assembly of the fixture 52 and rods 32 sufficient to contain a (temporary) fluid phase insulating medium, such as an epoxy. Any of a wide choice of epoxy materials may be found to be useful and a particular choice will depend upon electric field strength to be applied, outgassing characteristics, possible contaminating effects (upon the analysis instrument) realized from low energy ion induced erosion, mechanical and thermal properties and the like. These aspects are outside the scope of this work. By way of example, a commercially available epoxy, Epoxi-patch (1C-white), available from Dexter Corporation, Seabrook, NH, has been employed with satisfactory results. Molds 50 and fixture 52 were constructed of tetrafluoroethylene (Teflon) which will easily slide off the resulting casting.

It will be clear to one skilled in the art that the above embodiments may be altered in many ways without departing from the scope of the invention. Suitable applications of the conveyer may include applications other than mass spectroscopy applications. The ion guide need not be straight, but can take on a desired non-linear trajectory. Lengthy guides may be achieved with more collars spaced appropriately. Accordingly, the scope of the invention should be determined by the following claims and their legal equivalents.

What is claimed is:

1. An ion guide assembly comprising (a) 2N rods equidistantly spaced from a central axis and (b) at least one support collar for supporting said rods and for electrically connecting N alternate said rods, whereby each adjacent pair of rods are electrically unconnected, said collar comprising an insulating ring having first and second axially displaced grooves formed on the outer azimuthal periphery thereof, each said groove intercepting N radially directed holes therethrough, said radially directed holes each aligned with a rod conformal surface portion on the inner azimuthal periphery for locating corresponding said alternate rods, whereby said N holes of said first groove are azimuthally shifted by $\pi/N$ with respect to the N holes of said second groove, and (c) an electrical conductor disposed in each said groove to contact a corresponding said rod through a respective said radially directed hole.

2. The ion guide of claim 1 wherein said conductor comprises a wire and said wire is spot-welded to said corresponding rod.

3. The ion guide of claim 1 wherein N=3 and said ion guide supports a 2 dimensional hexapolar field.

4. The ion guide of claim 1 wherein said axis comprises a straight line.

5. A system for ion analysis comprising an ion source and an analysis device spaced apart from said ion source, and an ion guide assembly therebetween, said ion guide assembly comprising (a) a plurality of 2N rods, (b) at least one support collar for supporting said rods equidistant from a central axis and for electrically connecting N alternate said rods, whereby each adjacent pair of rods are electrically unconnected, (c) said collar comprising an insulating ring having first and second axially displaced grooves formed on the azimuthal periphery thereof, each said groove intercepting N radially directed holes therethrough, said radially directed holes each aligned with a rod-conformal surface portion on the inner azimuthal periphery for locating corresponding said alternate rods, whereby said N holes of said first groove are azimuthally shifted by $\pi/N$ with respect to the N holes of said second groove, and an electrical conductor disposed in each said groove to contact said corresponding rod through a respective radially directed hole.

6. The method of stably supporting 2N rods to produce a 2 dimensional electric multipole field distribution comprising (a) forming 2N rod conformal surface regions equally spaced azimuthally on the inner surface of an insulating ring, (b) producing first and second grooves on the outer peripheral surface of said ring, (c) drilling N radially directed holes in each said groove in alignment with alternating corresponding said rod conformal surfaces, (d) bringing each said 2N rods into intimate contact with said rod conformal surfaces, (e) separately disposing within each said first and second grooves respective first and second electrical conductors and contacting each said rod through a corresponding radially directed hole with one said conductor.

7. The method of claim 6 further comprising energizing said rod assembly by contacting said first conductor with a first electrical potential and contacting the second conductor with an opposite polarity potential.

8. The method of claim 7 wherein said opposite polarity potentials comprise a DC voltage drop.

9. The method of claim 7 wherein said opposite polarity potentials comprise AC voltages having a substantial phase shift therebetween.

10. The method of stably supporting 2N rods to produce a 2 dimensional electric multipole field distribution comprising (a) capturing 2N rod conformal surface regions equally spaced azimuthally on the outer surface of a fixture, (b) bonding a first wire to alternate said rods for electrical contact therewith while establishing an electrically isolate relation to rods disposed between said alternate said rods, and bonding a second wire to each said rods disposed between said alternate said rods while establishing an electrically isolate relation to said alternate said rods, whereby electrical conducting bonds are established between said first wire and a first group of N rods and electrical conducting bonds are established between said second wire and a second group of N rods, (c) placing a mold surrounding said rods in the regions proximate said bonds, (d) introducing a castable electrically insulating medium in a temporary fluid phase into said mold and allowing said medium to transform into a solid phase, and (e) removing said mold and said fixture from the resulting assembly of said rods.

11. The method of claim 10 further comprising providing a first electrical lead to said first group of rods and a second electrical lead to said second group of rods.

* * * * *